United States Patent [19]

Castenada, Jr. et al.

[11] Patent Number: 4,474,116

[45] Date of Patent: Oct. 2, 1984

[54] SAFE BOX WITH ANCHOR CHAIN

[76] Inventors: Ray Castenada, Jr.; Laura M. Castenada, both of P.O. Box 6246, Hayward, Calif. 94540

[21] Appl. No.: 495,080

[22] Filed: May 17, 1983

[51] Int. Cl.[3] ..... E05G 1/02

[52] U.S. Cl. ..... 109/51; 109/50; 109/53; 70/63; 211/4; 248/551

[58] Field of Search ..... 109/50, 51, 52, 53, 109/57; 70/58, 63, 78, 76, 448; 220/18; 211/4; 248/551, 553; 24/116 R, 116 A

[56] References Cited

U.S. PATENT DOCUMENTS

| | | | |
|---|---|---|---|
| 1,468,991 | 9/1923 | Butner | 109/50 |
| 1,531,770 | 3/1925 | Walker | 24/116 R |
| 2,180,117 | 11/1939 | Lipsis | 70/200 |
| 2,586,758 | 2/1952 | Zerr | 24/116 R |
| 3,690,130 | 9/1972 | Eutzler | 211/4 |
| 3,756,048 | 9/1973 | Portus | 70/58 |
| 4,066,195 | 1/1978 | Dickler | 70/58 |
| 4,069,691 | 1/1978 | Simpson | 211/4 |
| 4,204,601 | 5/1980 | Thomas | 211/4 |
| 4,243,088 | 1/1981 | Labonville | 24/116 R |
| 4,336,885 | 6/1982 | Thomas | 211/4 |

FOREIGN PATENT DOCUMENTS

| | | | |
|---|---|---|---|
| 6024 | 8/1956 | Fed. Rep. of Germany | 24/116 A |
| 6617742 | 7/1967 | Netherlands | 109/53 |
| 120384 | 12/1947 | Sweden | 70/58 |
| 230385 | 4/1941 | Switzerland | 70/63 |
| 124165 | 3/1979 | United Kingdom | 109/52 |

*Primary Examiner*—Gene Mancene
*Assistant Examiner*—John G. Weiss
*Attorney, Agent, or Firm*—Harvey B. Jacobson

[57] ABSTRACT

A housing is provided including peripherally extending side walls and a fixed wall extending between one set of corresponding marginal portions of the side walls. The side of the housing opposite the fixed wall is open and a cover is provided for the open side of the housing. The cover and housing include structure operable to releasably lock the cover in a closed position. At least one of the side walls has a slot formed therein opening through the free edge thereof remote from the fixed wall and a link chain section composed of interconnected links includes at least one link intermediate the opposite ends of the link chain section which may be received through the slot. The chain section and the portions of the one side wall defining the slot include coacting structure preventing longitudinal displacement of the chain section through the slot. In this manner the end of the chain section disposed exteriorly of the housing may be anchored relative to a stationary object in order to prevent removal of the housing. Also, various structures are provided within the housing further locking additional links of the link chain section within the housing, whereby the slot in the side wall through which the one link extends does not comprise the sole structure for anchoring the end of the link chain section within the housing and to the latter. The link chain section may be substituted for by a cable having longitudinally spaced abutments thereon.

12 Claims, 20 Drawing Figures

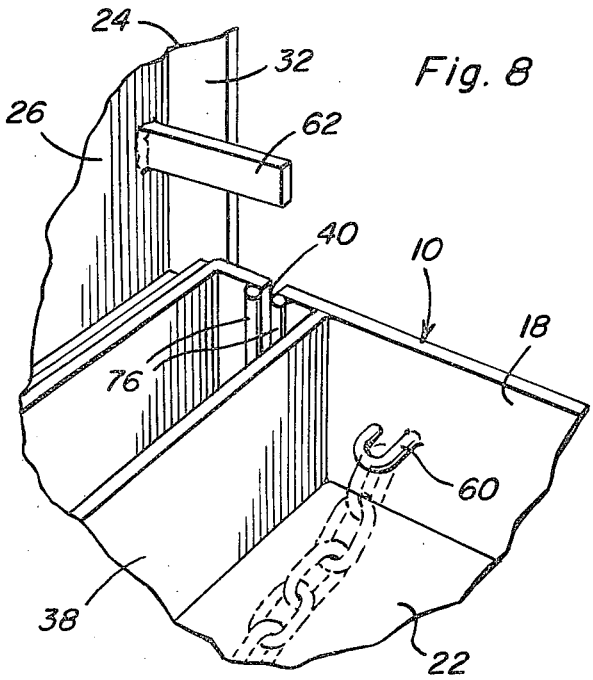
Fig. 8
Fig. 9
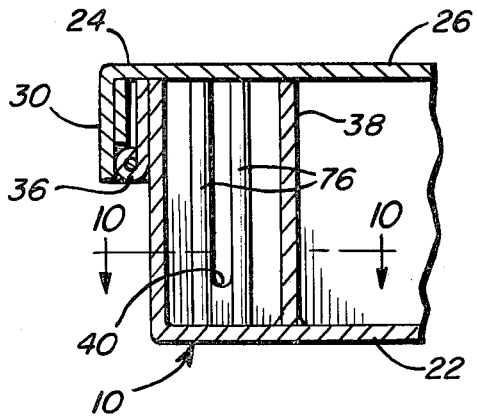
Fig. 10
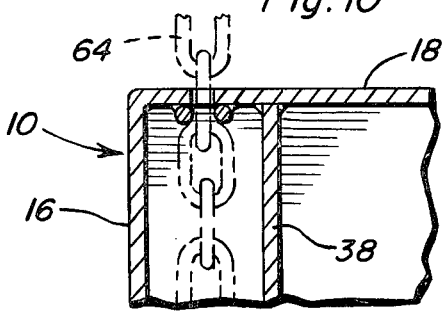
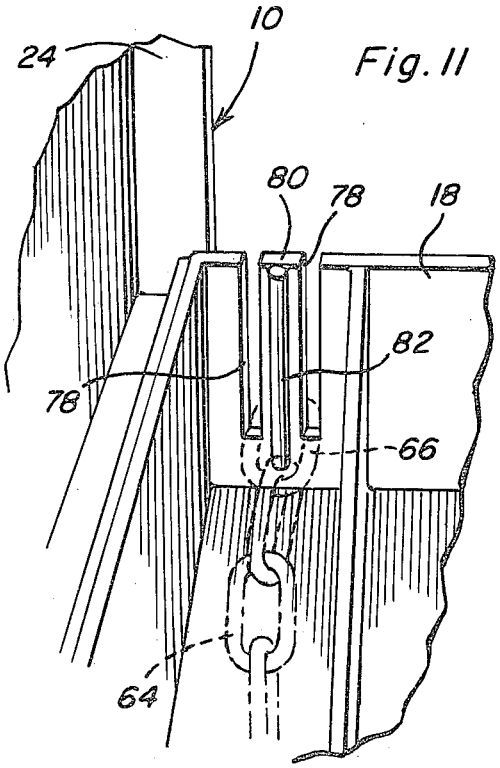
Fig. 11
Fig. 12
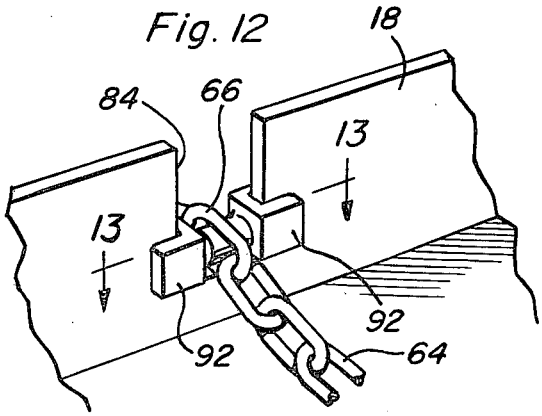
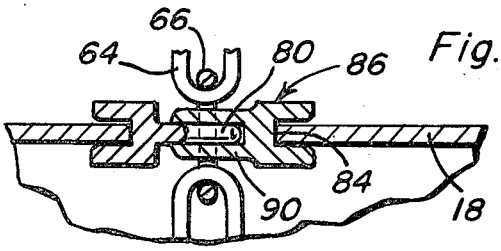
Fig. 13
Fig. 14
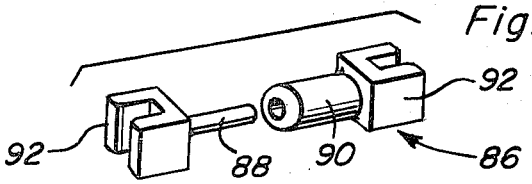

Fig. 15
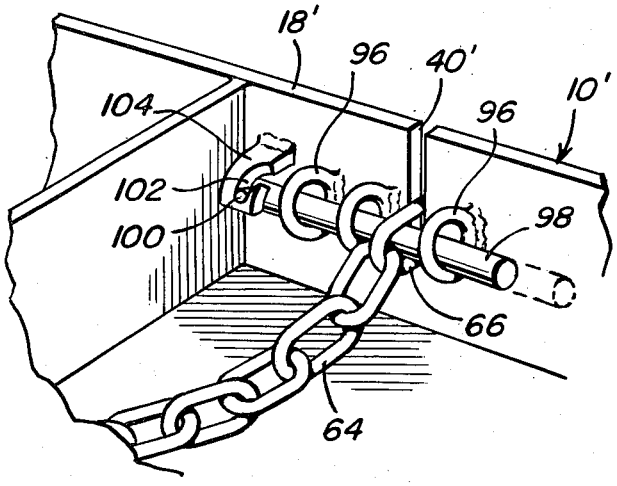
Fig. 16
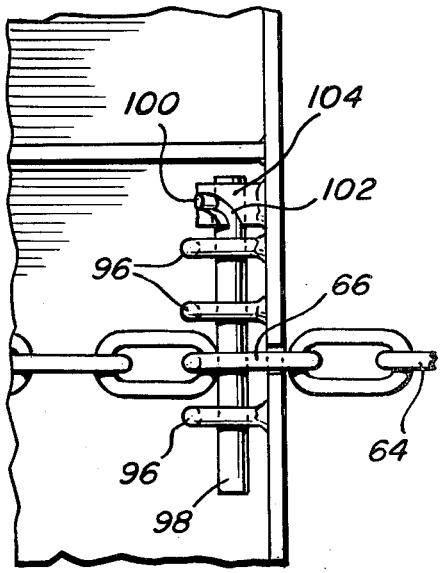
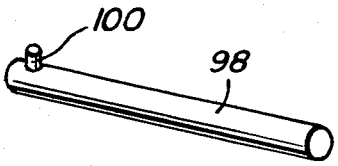
Fig. 17
Fig. 18
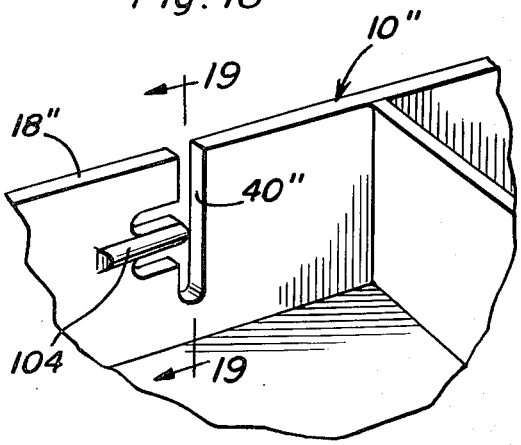
Fig. 19
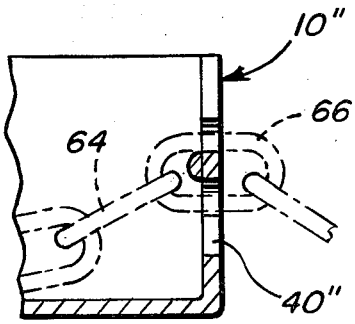
Fig. 20
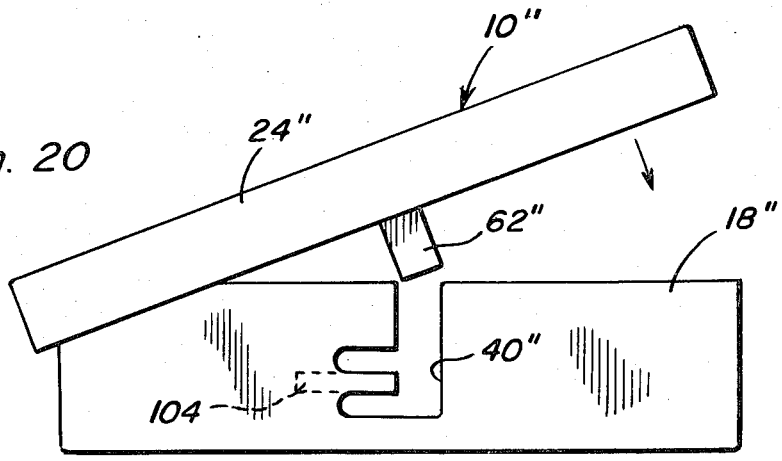

SAFE BOX WITH ANCHOR CHAIN

BACKGROUND OF THE INVENTION

Various different forms of safe boxes heretofore have been provided and when a safe box is constructed of adequately thick high strength metals and provided with a secure and armored lock, all but extraordinary means for opening such a safe box are prevented. Accordingly, inasmuch as such extraordinary means usually may not be practiced without the use of tools which are not normally carried by a burglar or which may be difficult to transport, the only manner in which entrance into a strongly constructed safe box may be gained is for a burglar or other thief to steal the safe box and to transport the same to an area in which the necessary extraordinary means to open the safe box may be carried out.

Therefore, it is extremely important to provide a safe box with means by which it may be anchored relative to an immovable object. If such anchoring can be accomplished in a manner to prevent removal of the safe box independent of extraordinary means, all but the most serious attempts to gain access to the contents of a safe box are prevented.

Accordingly, a need exists for a strongly constructed safe box, such as those which are presently commercially available, incorporating means by which the safe box may be suitably anchored to an immovable object in order to prevent its removal by other than extraordinary means.

Examples of various different forms of safe boxes including means for anchoring the safe boxes relative to immovable objects as well as various forms of anchoring devices to be used in conjunction with other objects to be prevented from being stolen are disclosed in U.S. Pat. Nos. 486,256, 924,824, 1,352,906, 1,500,977, 1,796,502 1,955,809, 2,180,117 2,755,748, 2,911,814 and 3,625,031.

BRIEF DESCRIPTION OF THE INVENTION

The safe box of the instant invention includes basic safe box construction of heavy gauge material and an armored lock for the hinged top wall of the safe box. In addition, the safe box is equipped with an anchor chain or cable of hardened high strength metal and the safe box is provided with structure whereby either one or both ends of the anchor chain may be securely anchored within the box. This will enable the mid-portion of the chain to be encircled about an immovable object in order to tether the safe box to that object, or enable one end of the chain to be anchored relative to an immovable object while the other end of the chain is anchored within the safe box.

The main object of this invention is to provide a safe box of high strength construction and including structure whereby either one or both ends of an anchoring chain or cable may be anchored within the box.

Another object of this invention is to provide a safe box including internal structure whereby various longitudinally spaced portions of a single chain end or two chain ends may be anchored at different points within the safe box.

A further object of this invention is to provide an anchoring system for a safe box which may be readily incorporated into the manufacture of presently constructed safe boxes and which may also be included in modifications to existing safe boxes.

A final object of this invention to be specifically enumerated herein is to provide an anchoring system for safe boxes which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is a fragmentary perspective view of the safe box illustrating a first method of reinforcing the chain link receiving slots formed in remote side walls of the safe box;

FIG. 9 is a fragmentary vertical sectional view illustrating more clearly the slot edge reinforcing structure illustrated in FIG. 8;

FIG. 10 is a fragmentary horizontal sectional view taken substantially upon the plane indicated by the section line 10—10 of FIG. 9;

FIG. 11 is a fragmentary perspective view illustrating a modified form of safe box side wall slot construction and a second modified form of slot marginal portion reinforcing structure;

FIG. 12 is a fragmentary perspective view illustrating yet another form of safe box side wall slot including a modified form of chain link anchoring structure operatively associated therewith;

FIG. 13 is a fragmentary enlarged horizontal sectional view taken substantially upon the plane indicated by the section line 13—13 of FIG. 12;

FIG. 14 is an exploded perspective view of the side wall slot engaged chain link anchoring structure illustrated in FIGS. 12 and 13;

FIG. 15 is a fragmentary view of a safe box utilizing a lock bolt as well as a side wall slot to anchor one end of a chain within the box;

FIG. 16 is a top plan view of the structure shown in FIG. 15;

FIG. 17 is a perspective view of the lock bolt shown in FIGS. 15 and 16;

FIG. 18 is a fragmentary view of still another safe box utilizing an inverted F-shaped side wall chain anchoring slot;

FIG. 19 is a vertical section view taken upon the section line 19—19 of FIG. 18; and FIG. 20 is a fragmentary side elevational view of a safe box incorporating the structure of FIGS. 18 and 19.

DETAILED DESCRIPTION OF THE INVENTION

Figure 1:
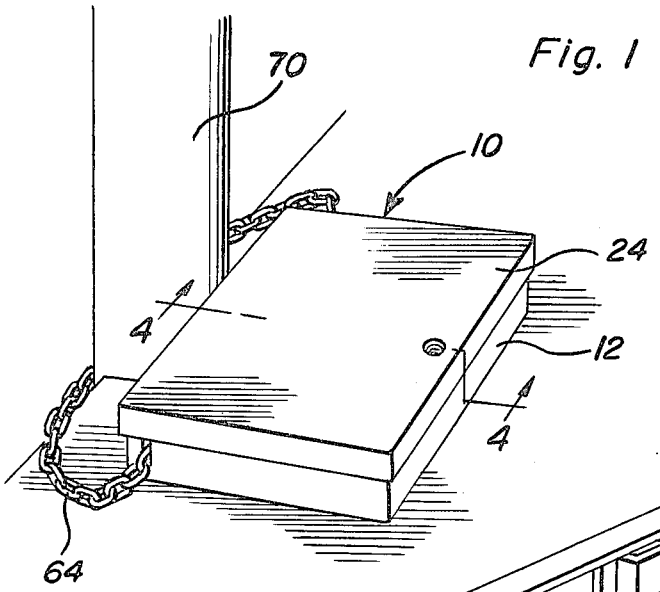
FIG. 1 is a perspective view of a safe box constructed in accordance with the present invention and with the cover of the safe box locked in a closed position and opposite end portions of an anchoring chain anchored within the safe box while an intermediate length portion of the chain is passed about a non-movable object.
Figure 2:
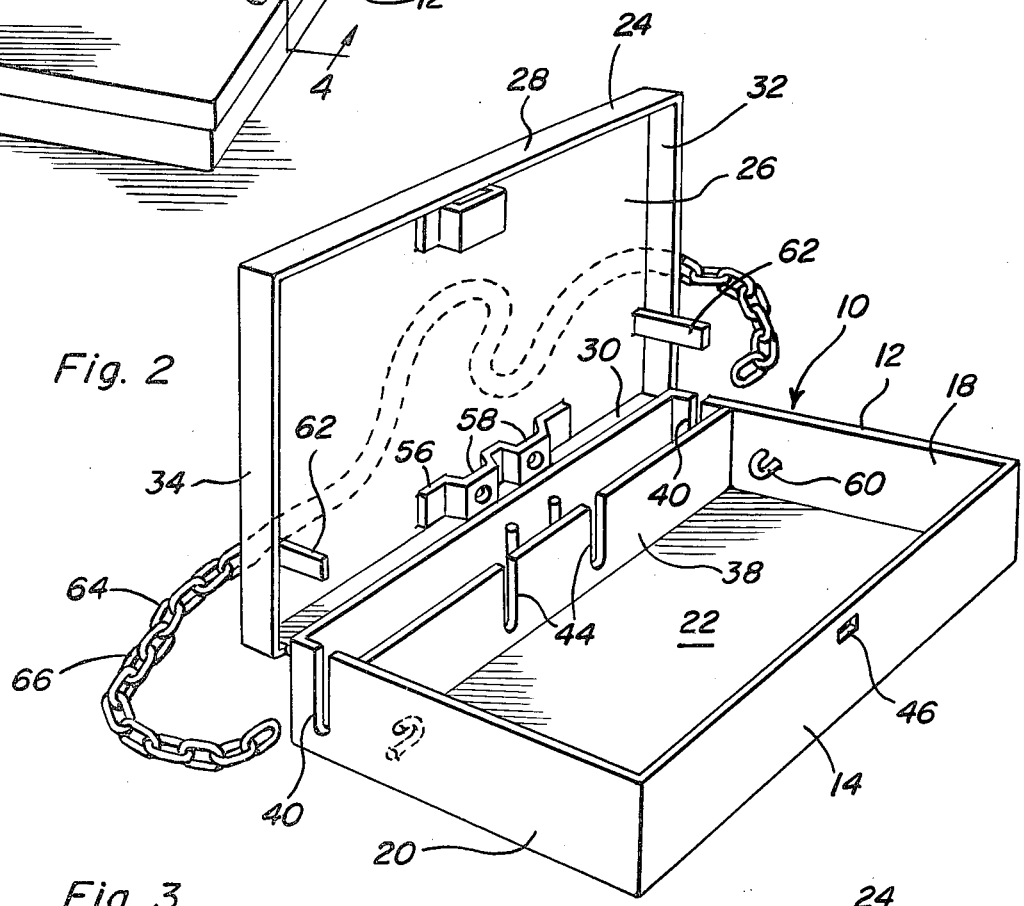
FIG. 2 is an enlarged perspective view of the safe box illustrated in FIG. 1 with the hinged cover thereof in an open position and the end portions of the anchor chain released from engagement with the safe box.
Figure 3:
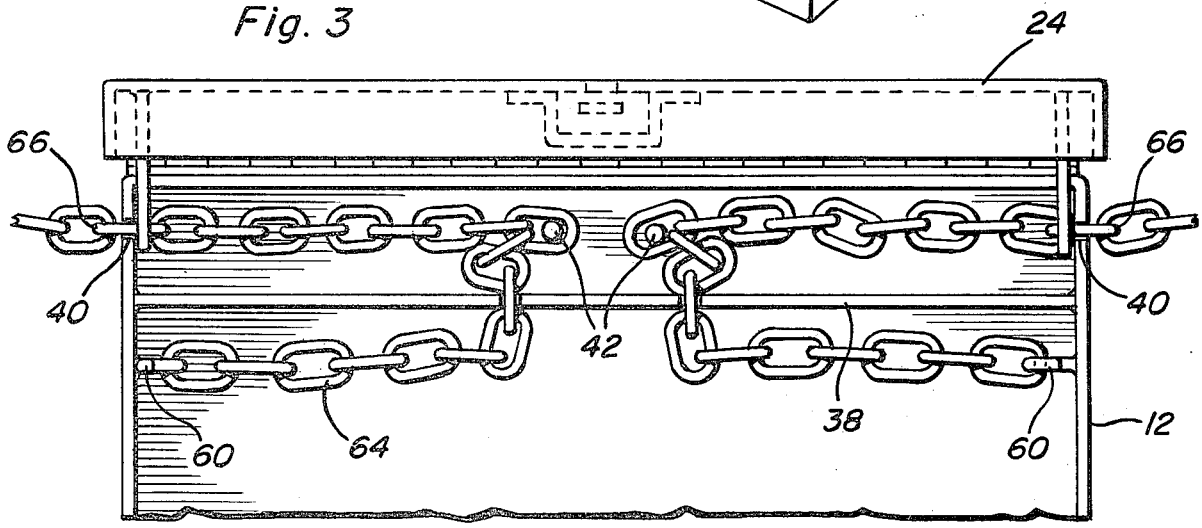
FIG. 3 is an enlarged fragmentary plan view of the assemblage illustrated in FIG. 2 but with the opposite end portions of the anchor chain each anchored in four different locations relative to the anchor box.

Referring now more specifically to the drawings the numeral 10 generally designates the safe box of the instant invention. The box 10 includes a lower part 12 consisting of front and rear walls 14 and 16, opposite end walls 18 and 20 and a bottom wall 22 secured and extending between the lower marginal edges of the walls 14, 16, 18 and 20. In addition, the safe box 10 includes an upper part or cover 24 consisting of a top wall 26 and depending peripherally extending flanges including a front flange 28, a rear flange 30 and opposite end flanges 32 and 34. The rear flange 30 of the upper part 24 is hinged to the rear wall 16 of the lower part 12 by a hinge construction 36 sandwiched between the opposing sides of the wall 16 and flange 30. The rear portion of the lower part 12 includes a transverse upstanding partition 38 spaced slightly forward of the rear wall 16.

The end walls 18 and 20, in the areas thereof between the rear wall 16 and the partition 38, include upstanding upwardly opening slots 40 formed therein and the bottom wall 22 includes a pair of upstanding pins 42 secured thereto and projecting upwardly therefrom. The pins 42 are rigidly attached to the bottom wall 22 and are slightly spaced apart longitudinally of the bottom wall 22. In addition, the partition 38 includes a pair of narrow upstanding upwardly opening slots 44 formed therein at points spaced longitudinally along the mid-portion thereof. The spacing between the slots 44 is slightly greater than the spacing between the pins 42.

The front wall 14 has an upper central keeper opening 46 formed therein and a key operated armored lock 48 is supported from the forward central portion of the top wall 26 and includes an extendible and retractable bolt 50 projectible through and retractable from the keeper opening 46. The keeper opening 46 is lapped over by the front flange 28 when the upper part or top 24 is swung to the closed position thereof illustrated in FIG. 4 and the top wall 26 includes a key opening 52 formed therein through which a key 54 for operating the lock 48 may be inserted. If it is desired, the top wall 26 disposed about the opening 52 may be armored.

Figure 4:
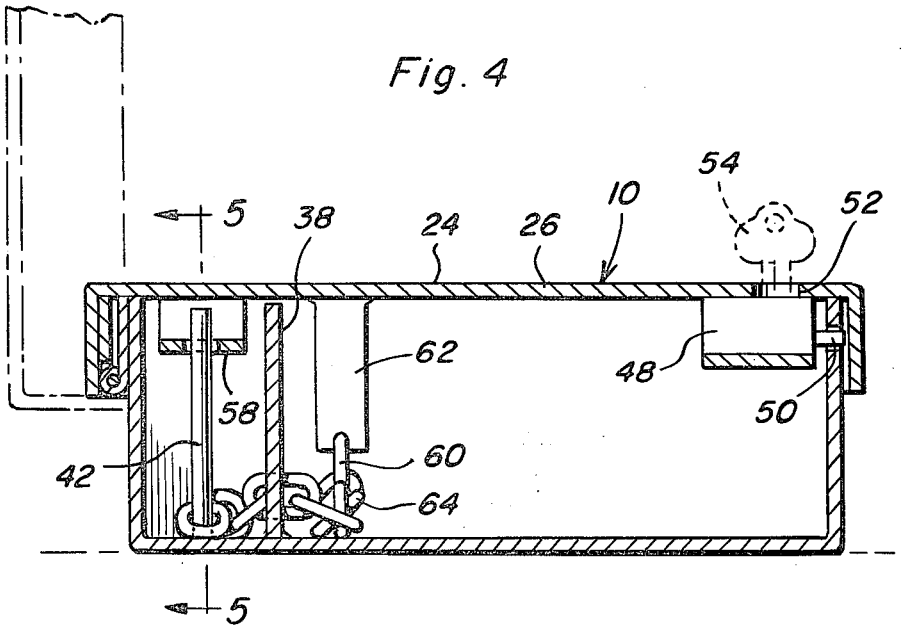
FIG. 4 is an enlarged vertical sectional view taken substantially upon the plane indicated by the section line 4—4 of FIG. 1.

The rear central portion of the top wall 26 includes a heavy gauge bracket 56 securely anchored to the undersurface thereof and the bracket 56 includes depressed apertured portions 58 through which the upper ends of the pins 42 are received when the top 24 is in the closed position illustrated in FIG. 4. Also, the rear portions of the side walls 18 and 20 spaced slightly forward of the partition 38 include J-shaped hooks 60 supported therefrom and the end flanges 32 and 34 of the top 24 include securely anchored depending plates 62 supported therefrom which are received in the open portions of the hooks 60 when the top 24 is in the closed position of FIG. 4.

A link chain section 64 is provided and comprises a plurality of interconnected links 66. The link chain section 64 is constructed of hardened metal and resists separation by all but extraordinary measures. The links 66 are of a size to be received through the slots 40 and 44, to be received over the pins 42 and to be engaged with the hook 60. Accordingly, the opposite ends of the link chain section 64 may be passed through the slots 40, over the pins 42, through the slots 44 and engaged with the hooks 60, those portions of the chain section 64 extending between the slots 40 and the adjacent ports 42 being only slightly slack. Upon closing the top 28 the upper ends of the slots 40 and 44 are closed by the closely overlying top wall 26, the upper ends of the pins 42 are closed by the apertured portions 58 and the plates 62 close the openings of the hooks 60. Accordingly, each of the ends of the chain section 64 is anchored in four points relative to the safe box 10. Accordingly, when the mid-portion of the link chain section 64 is passed about an immovable object such as the post 70 illustrated in FIG. 1 and the top of the box is locked, all but extraordinary measures are unsuccessful to open the box 10 or to remove the box 10 from close proximity to the post 70.

Figure 7:
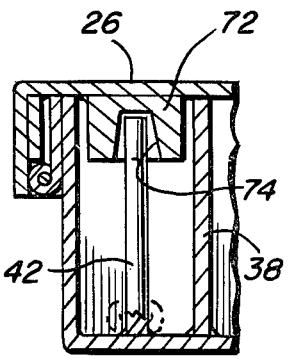
FIG. 7 is a fragmentary vertical sectional view taken substantially upon the plane indicated by the section line 7—7 of FIG. 6.
Figure 5:
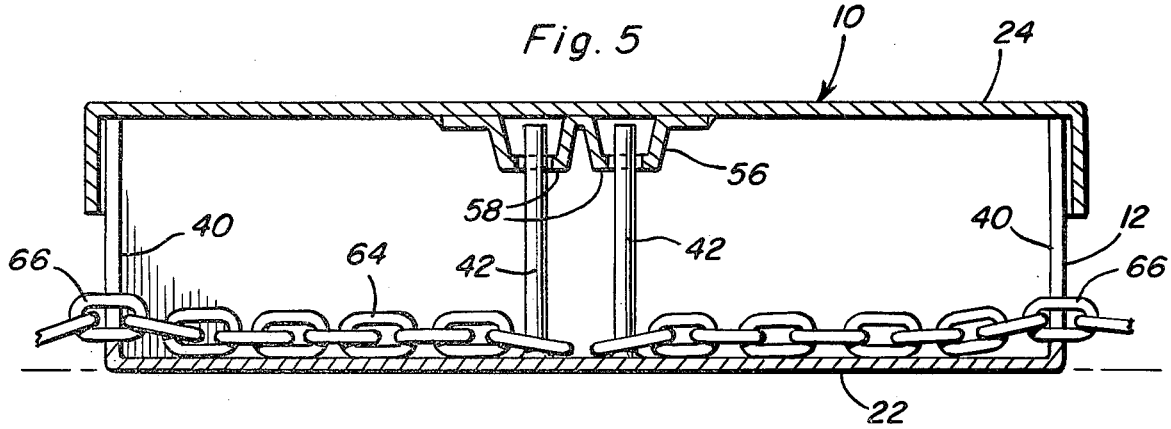
FIG. 5 is a vertical sectional view taken substantially upon the plane indicated by the section line 5—5 of FIG. 4.
Figure 6:
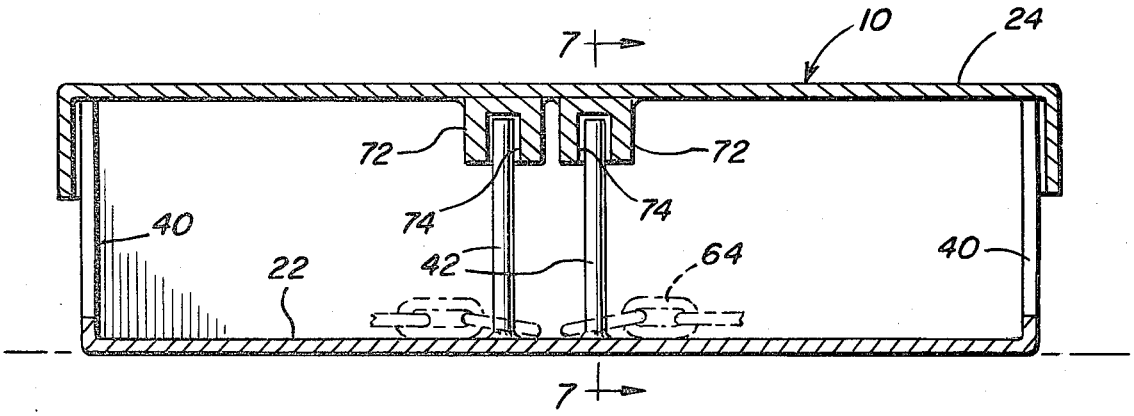
FIG. 6 is a vertical sectional view similar to FIG. 5 but illustrating a modified form of top wall mounted brace structure for the chain anchoring pins within the rear portion of the safe box.

With attention now invited more specifically to FIG. 7 of the drawings, a slightly modified means of closing the upper ends of the pins 42 may be seen. In the modification illustrated in FIG. 7, a pair of abutment blocks 72 are secured to the undersurface of the top wall 26 in lieu of the bracket 56 and each of the abutment blocks 72 includes a downwardly flaring recess 74 formed therein in which the upper end of the corresponding pin 42 is received when the top 24 is in the closed position.

With attention now invited more specifically to FIG. 8 of the drawings, it may be seen that the marginal edges of the end walls 18 and 20 defining the slots 40 may be reinforced through the utilization of reinforcing rods 76 extending along and securely anchored to the marginal portions of the end walls 18 and 20 defining the slots 40.

FIG. 11 of the drawings illustrates a further modified form of slotted end wall wherein each end wall 18 and 20 is provided with a pair of slightly spaced apart slots 78. A tongue portion 80 of each end wall is disposed between each pair of slots 78 and each tongue portion 80 may be reinforced by a reinforcing rod 82 securely anchored to the inner side thereof. It will be noted that the spacing between the slots 78 is such to allow the opposite side portions of a selected link 66 of the link chain section 64 to be received in the slots 78 with the tongue portion 80 received through the center of that link 66.

FIG. 12 illustrates yet another form of slotted end wall 18 wherein the slot 84 formed therein is wider than the slots 40 and 78 and will readily slidably receive the entire link chain section 64 therethrough. However, each slot 84 is equipped with a keeper bolt assembly referred to in general by the reference numeral 86 comprising telescopingly engageable pin and sleeve portions 88 and 90 including bifurcated remote ends 92. The bifurcated remote ends 92 are slidably engageable with the marginal portions of the end wall 18 defining the slot 84 and the telescopingly engaged pin and sleeve portions 90 provide a high strength keeper bolt which is receivable through a selected link 66 of the link chain section 64. Of course, upward withdrawal of the keeper bolt assembly 86 from the slot 84 is prevented by the lower marginal edge of the corresponding end flange of the top 28 which closely overlies the keeper bolt assembly 86 when the top 24 is in a closed position.

With attention now invited more specifically to FIG. 15, there may be seen yet another modified form of safe box referred to in general by the reference numeral 10' and wherein each end wall 18' thereof includes a slot 40' corresponding to the slot 40 and through which one link 66 of the chain link section 64 is receivable. However, in order to reinforce the end wall 18', the end wall 18' includes a pair of eye members 96 supported therefrom in aligned relation on opposite sides of the slot 40' and a latch bolt 98 is passed through the eye members 96 as well as the link 66. One end of the latch bolt 98 includes a laterally projecting pin 100 and the pin 100 is removably received within an arcuate slot 102 formed in a bracket 104 carried by the end wall 18'. Accordingly, lengthwise withdrawal of the link chain section 64 through the slot 40' is prevented by the latch bolt 98 and the lateral projection 100 received within the notch 102 latches the bolt 98 against axial disengagement from the eye members 96.

With attention now invited more specifically to FIGS. 18–20, yet another modified form of safe box 10'' is illustrated. The safe box 10'' includes opposite end walls 18'' corresponding to the end walls 18 and each end wall 18'' includes an inverted F-shaped slot 40'' formed therein and which opens upwardly through the upper marginal portion of the corresponding end wall 18''. In addition, the safe box 10'' includes a pair of plates 62'' corresponding to the plates 62 and the end walls 18'' are each provided with an interior reinforcing rod 104. Accordingly, as may best be seen from FIG. 19, a selected length 66 of the link chain section 64 may be engaged with the reinforced portion of the end wall 18'' and the top or upper part 24'' of the lock box 10'' may be swung to the closed position with the plates 62'' preventing disengagement of the selected link 66 from the reinforced portion of the end wall 18'' and thereby enabling the reinforced portion of the end wall 18'' to prevent axial withdrawal of the link chain section 64.

It is to be noted, however, that the safe boxes 10' and 10'' may also include the equivalent of the pins 42, the partition 38 equipped with the slots 44 and the hooks 60. However, the safe boxes 10, 10' and 10'' each may be provided independent of the equivalent of the slotted partition 38, the pins 42 and the hook 60. In such cases, only the slotted end walls will be relied upon to prevent withdrawal of the link chain section ends from the safe boxes.

As previously set forth, a cable may be substituted for the chain section 64 with that chain including spaced abutments which may not pass through the various slots. Further the cable ends may be removably secured together by any suitable means including a pair of ring or eye ends thereof having a fastener secured therethrough. The secured ring or eye ends (as well as similar chain section end links) may be disposed either in the area between rear wall 16 and partition 38 or between partition 38 and front wall 14. Further, a plain cable may be used if the ends thereof are removably secured together anywhere within box 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A safe box with anchor chain, said safe box including an upwardly opening lower part of appreciable depth and provided with upwardly projecting peripheral walls including a pair of remote oppositely outwardly facing side wall portions, a downwardly opening cover provided with downwardly projecting peripheral flanges including a pair of remote oppositely outwardly facing flange portions corresponding to said wall portions, said cover being positionable over said lower part with said flanges telescopingly engaged over said peripheral walls to close said lower part from above, means operable to releasably lock said cover in position closing said lower part, said wall portions each having a narrow upstanding slot formed therein opening upwardly through the upper free edge thereof, a link chain section composed of interconnected links and including opposite end portions having a first pair of links spaced from the end links of the corresponding end portion terminal ends and removably received downwardly sideways, only, in a corresponding slot, said portions of said flanges closing said slots from above when said cover is in the closed position, a pair of upstanding posts rigidly mounted from and projecting upwardly from said lower part inwardly of and disposed along a path extending between said side wall portions, said link chain section including a second pair of opposite end portion links spaced between the first pair of links and said end links downwardly telescoped over the upper ends of said posts, said cover, when said cover is in the closed position, closely overlying said post upper ends to prevent upwardly withdrawal of said second pair of links from said posts, said path closely paralleling the inner side of a peripheral wall of said lower part extending between said wall portions, an upstanding partition supported from said lower part, extending and secured between said wall portions and closely paralleling the side of said path remote from the last-mentioned peripheral wall, whereby said partition serves to reinforce said wall portions on one pair of corresponding sides of said slots and said last-mentioned peripheral wall serves to reinforce said wall portions on the other pair of corresponding sides of said slots, said flange portions, when said cover is in the closed position, downwardly closely overlapping appreciable vertical extent portions of said side wall portions defining the upper end portions of said slots, whereby said flange portions serve to reinforce said wall portions against outward deflection, the spacing between said side wall portions and the adjacent posts and the spacing between each link of said first pair of links and the adjacent link of the second pair of links being such that said chain section is only slightly slack between each post and the adjacent side wall portion slot.

2. The safe box of claim 1 wherein said partition includes a pair of upwardly opening slots formed therein downwardly into which a third pair of links of said chain section spaced between said end and second links are sideways, only, receivable, the upper portions of said partition disposed on opposite sides of the last mentioned slots being closely opposed by an opposing inner surface of said cover to prevent withdrawal of said third links upwardly from the slots in said partition when said top wall is in the closed position.

3. The safe box of claim 2 wherein the interior of said lower part includes anchor means on the side of said partition remote from said path with which fourth links of said chain section may be removably retentively engaged when said cover is moved to an open position.

4. The safe box claim 1 wherein said cover includes a heavy gauge bracket mounted on the underside thereof and defining socket means which open downwardly when said top wall is in the closed position and into which the upper ends of said posts are telescoped when said cover is in the closed position to prevent lateral deflection of the upper ends of said posts in all directions.

5. The safe box of claim 1 wherein the marginal portions of said one side wall defining said slot being reinforced along the inner surfaces thereof.

6. The safe box of claim 1 wherein each side wall portion includes a second slot formed therein closely paralleling the first mentioned slot and laterally spaced from said first mentioned slot a distance equal to the spacing between opposite side portions of said first links whereby each of the side portions of said first links may be downwardly received in a corresponding slot.

7. The safe box of claim 6 wherein the portion of each side wall portion disposed intermediate the corresponding slots is reinforced on its interior surface throughout at least substantially the entire vertical extent of thereof.

8. The safe box of claim 1 wherein the first slots are wider than the maximum width of said first links, partially telescopingly engaged elongated shank and sleeve portions including remote opposite ends, said remote opposite ends being bifurcated, said bifurcated opposite ends being slidably engaged with the opposing edge portions of said side wall portions defining the remote sides of said wall portion slots and with said telescopingly engaged shank and sleeve portions extending across the central areas of said wall portion slots, said sleeve passing through said link.

9. The safe box of claim 1 wherein the inner portions of said side wall portions disposed on opposite sides of the side wall slots include eye members supported therefrom, elongated lock bolts passed through said eye members and extending across the lower portion of said side wall slots, said lock bolts also passing through said first pair of links.

10. The safe box of claim 9 wherein one end of each lock bolt and the corresponding side wall portion include releasably engageable coacting structure operative to prevent longitudinal displacement of said lock bolt along the corresponding side wall portion.

11. The safe box of claim 1 wherein each side wall slot is inverted F-shaped in shape and includes a main vertical leg and a pair of horizontal lateral legs extending outwardly from the lower end and intermediate heighth portions of said vertical leg, said horizontal legs being spaced vertically apart a distance substantially equal to the spacing between opposite side portions of said the corresponding link and each of said side portions of said link being received in one of said horizontal legs.

12. The safe box structure of claim 11 wherein the area of said side wall disposed between said horizontal legs is reinforced on its interior surface.

* * * * *